US006250092B1

(12) United States Patent
Lanz et al.

(10) Patent No.: US 6,250,092 B1
(45) Date of Patent: Jun. 26, 2001

(54) ACTUATOR AND METHOD FOR CONTROLLING TEMPERATURES IN A MULTIPLE COMPARTMENT DEVICE

(75) Inventors: Douglas C. Lanz, Irwin; Robert W. Starenchak, Greenburg, both of PA (US)

(73) Assignee: Robertshaw Controls Company, Richmond, VA (US)

( * ) Notice: Subject to any disclaimer, the term of this patent is extended or adjusted under 35 U.S.C. 154(b) by 0 days.

(21) Appl. No.: 09/499,906

(22) Filed: Feb. 8, 2000

(51) Int. Cl.[7] ..... F25D 17/04

(52) U.S. Cl. ..... 62/187; 62/180; 62/408; 62/229; 236/99 G; 236/49.5

(58) Field of Search ..... 62/187, 186, 180, 62/229, 407, 408, 441; 236/99 R, 99 G, 100, 49.5; 251/58, 62, 63.4, 231, 326

(56) References Cited

U.S. PATENT DOCUMENTS

| | | | | |
|---|---|---|---|---|
| 2,584,305 | * | 2/1952 | Taylor | 236/49.5 X |
| 2,907,180 | * | 10/1959 | Mann | 62/187 X |
| 2,958,207 | * | 11/1960 | Braneky | 236/49.5 X |
| 3,645,108 | * | 2/1972 | Houk | 62/187 |
| 5,732,561 | | 3/1998 | Kim | 62/89 |
| 5,778,694 | | 7/1998 | Jeong | 62/187 |
| 5,809,790 | | 9/1998 | Kwon | 62/89 |
| 5,816,061 | | 10/1998 | Lee et al. | 62/187 |
| 5,870,900 | | 2/1999 | Mohebbi et al. | 62/187 |
| 5,876,014 | | 3/1999 | Noritake et al. | 62/187 X |
| 5,899,083 | | 5/1999 | Peterson et al. | 62/186 |
| 5,901,562 | | 5/1999 | Tunzi et al. | 62/299 |

* cited by examiner

*Primary Examiner*—Harry B. Tanner
(74) *Attorney, Agent, or Firm*—John M. England, Jr.; Terrence (Terry) Martin; Jules Jay Morris

(57) ABSTRACT

An actuator is provided for controlling temperatures in a multiple compartment device wherein the actuator includes a housing and a linear oscillator disposed within the housing. The linear oscillator is coupled with an integral push rod, wherein the linear oscillator is adapted to reciprocably move the push rod along its longitudinal axis. In addition, the actuator includes a holder including a rigid member and a pin aperture. The sliding member has a knob on one end and first clip connector at an other end, the sliding member having a range of motion limited by the rigid member. The push rod has a second clip connector coupled to the first clip connector. A lever arm has a first end and a second end, the first end including a protruding member and the second end including a lever arm aperture and a lever arm pin. The knob is pivotably engaged with the lever arm aperture and the lever arm pin is pivotably engaged with the pin aperture. The protruding member is adapted to pivotably couple with the damper. In an alternate aspect, the present invention also provides a method of fabricating an actuator for facilitating the controlling of temperatures in a refrigerator.

10 Claims, 5 Drawing Sheets

ACTUATOR AND METHOD FOR CONTROLLING TEMPERATURES IN A MULTIPLE COMPARTMENT DEVICE

BACKGROUND OF THE INVENTION

1. Field of the Invention

This invention relates to environmental temperature controls and more particularly to systems for controlling temperatures in multiple compartment devices.

2. Background Information

The goal of most multiple compartment designs is to quickly and efficiently control the discrete compartment temperatures using one cold air source. This task becomes more difficult when there is a sudden temperature change in a compartment, for example, such as when a refrigerator door is opened and then closed.

Typically refrigerators have a partition that separates the freezer from the fresh food compartment. Refrigerators also have a cold air source, which directs cold air into the freezer. There is typically an aperture in the partition that allows the cold air in the freezer to migrate into the fresh food compartment. A damper selectively covers and uncovers the aperture in the partition to control the amount of cold airflow from the freezer to the fresh food compartment. Refrigerators usually have thermostats that control the cold air source.

One arrangement for controlling refrigerator compartment temperatures is to use a manually controlled damper and a thermostat located in the fresh food compartment. If the temperature in the freezer compartment suddenly increases, the damper will not move, and the cold air source will turn on when the warmer air has migrated from the freezer to the thermostat in the fresh food compartment. A drawback associated with this arrangement is that in most refrigerators, the freezer is located above the fresh food compartment and since heat rises, it could take a significant amount of time before the warmer air migrates down from the freezer to the thermostat in the fresh food compartment. This is especially true if the manual damper was positioned to substantially cover the aperture.

One proposed solution to this problem is to incorporate an automatic damper controller and a thermostat located in the freezer compartment rather than in the fresh food compartment. More specifically, the thermostat would control the cold air source in response to the temperature of the freezer compartment. Also, the automatic damper controller would incrementally control the damper in response to the temperature of the fresh food compartment.

A drawback to this system is that when the freezer compartment is cooled to its set point temperature, the cold air source will shut off, even if the fresh food compartment is warm and has not been sufficiently cooled. The set point temperatures refer to the preset high and low temperature range settings of the compartments. For example, when the air temperature in the fresh food compartment reaches a set point temperature, the cold air source will be either turned on or off. Hence, a need exists for a system which will quickly and efficiently control temperatures in a multiple compartment device in response to compartment temperature changes.

SUMMARY OF THE INVENTION

According to an embodiment of the invention, an actuator is provided for controlling temperatures in a multiple compartment device. The actuator includes a housing and a linear oscillator disposed within the housing. The linear oscillator is disposed integrally with a push rod, wherein the linear oscillator reciprocably moves the push rod along its longitudinal axis. In addition, the actuator includes a holder including a rigid member and a pin aperture. A sliding member has a knob on one end and a first clip connector at an other end, the sliding member having a range of motion limited by the rigid member. The push rod has a second clip connector on one end, which is coupled to the first clip connector of the sliding member. A lever arm has a first end and a second end, the first end including a protruding member and the second end including a lever arm aperture and a lever arm pin. The knob of the sliding member is pivotably engaged with the lever arm aperture and the lever arm pin is pivotably engaged with the pin aperture. The protruding member is adapted to pivotably couple with the damper.

The present invention provides, in another aspect, a method of fabricating an actuator for controlling temperatures in a refrigerator. A first step of this method is to provide a linear oscillator which is operable in response to input from a temperature sensor. Additional steps include integrally disposing a push rod with the linear oscillator, wherein the linear oscillator reciprocably moves the push rod along its longitudinal axis. A holder is provided which includes a rigid member and a pin aperture. A sliding member is provided which has a knob at one end and first clip connector at an other end, the sliding member having a range of motion limited by the rigid member. A second clip connector is provided on one end of the push rod. The second clip connector is coupled to the first clip connector of the sliding member. A first end of a lever arm is provided with a protruding member which is coupled with a damper. In this regard, those skilled in the art will recognize that any number of well-known coupling configurations, such as a pivot pin/receptacle, hinge, cam/follower, or resilient connector such as a metallic, polymeric or elastomeric spring, may be used in lieu of any of the coupling arrangements disclosed herein, without departing from the spirit and scope of the present invention.

A second end of the lever arm is provided with a lever arm aperture and a lever arm pin. The knob is pivotably engaged with the lever arm aperture, and the lever arm pin is pivotably engaged with the pin aperture.

The above and other features and advantages of this invention will be more readily apparent from a reading of the following detailed description of various aspects of the invention taken in conjunction with the accompanying drawings.

DETAILED DESCRIPTION OF THE PREFERRED EMBODIMENTS

Figure 1:
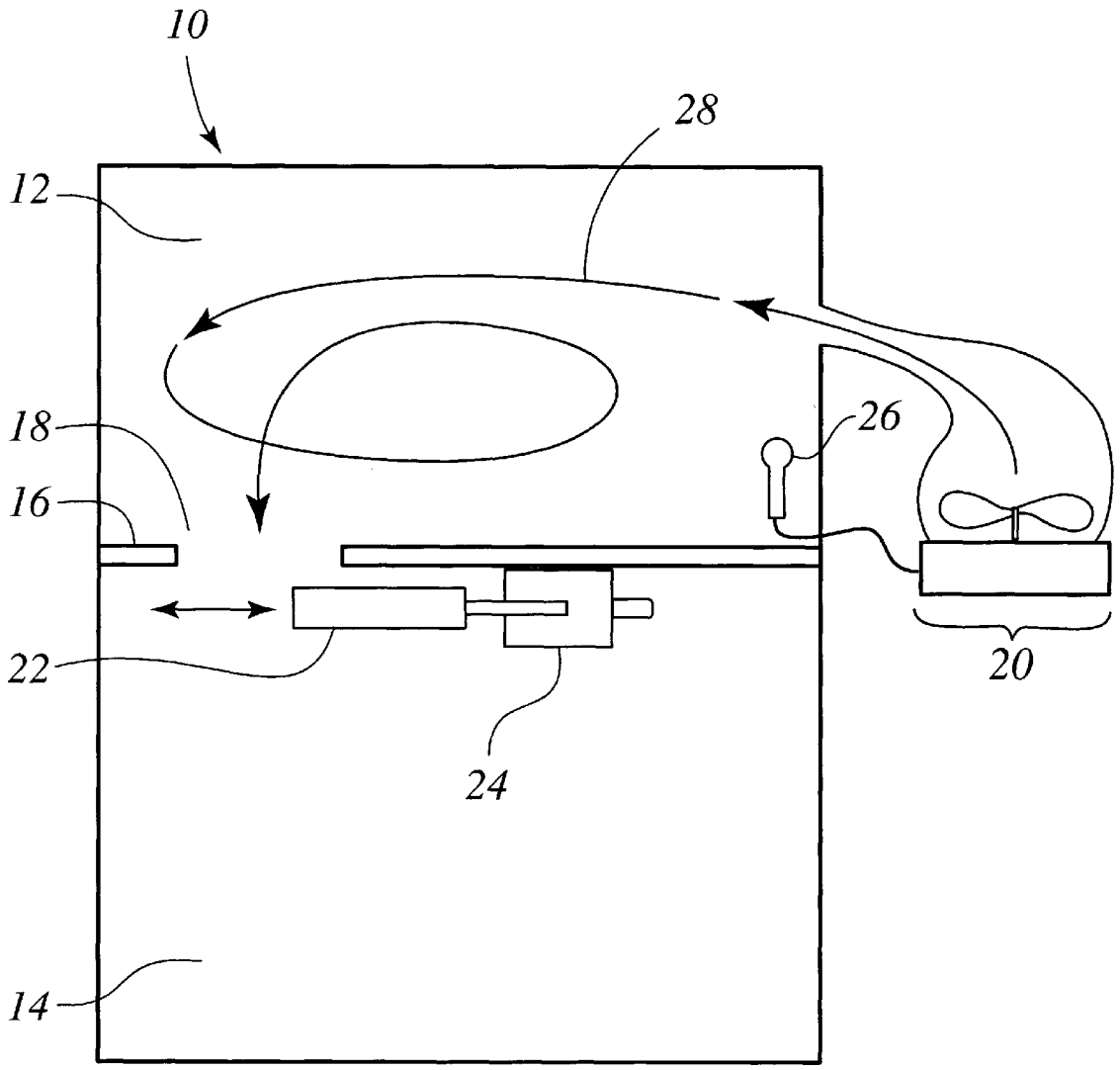
FIG. 1 (PRIOR ART)
FIG. 1 is a cross-sectional schematic representation of a refrigerator, which includes a prior art refrigeration system.

Referring to the Figures set forth in the accompanying Drawings, the illustrative embodiments of the present invention will be described in detail hereinbelow.

For clarity of exposition, like features shown in the accompanying Drawings shall be indicated with like reference numerals and similar features as shown in alternate embodiments in the Drawings shall be indicated with similar reference numerals.

As shown in FIG. 1, a typical prior art refrigerator 10 includes a relatively low temperature freezer compartment or freezer 12 and a relatively high temperature fresh food compartment 14. The freezer 12 and fresh food compartment 14 are usually separated by a partition 16 having an opening or aperture 18, which extends from the freezer 12 to the fresh food compartment 14. A cold air source 20, which normally includes a refrigerant condenser, evaporator (not shown) and a fan, is used to provide cold air to the freezer 12. The cold air source 20 is generally located behind the refrigerator 10 or below the fresh food compartment 14. In any event, it should be understood that most refrigerators include an air circulating system including a cold air source 20, which provides cold air directly to the freezer 12, while a portion of the cold air 28 is directed to the fresh food compartment 14 through an aperture 18 in the partition 16. In operation, the prior art cold air source 20 is controlled by a signal from the thermostat 26 located in the freezer 12. Also, the damper 22 and prior art automatic damper controller 24 are indirectly controlled by the temperature in the fresh food compartment 14.

Figure 2:
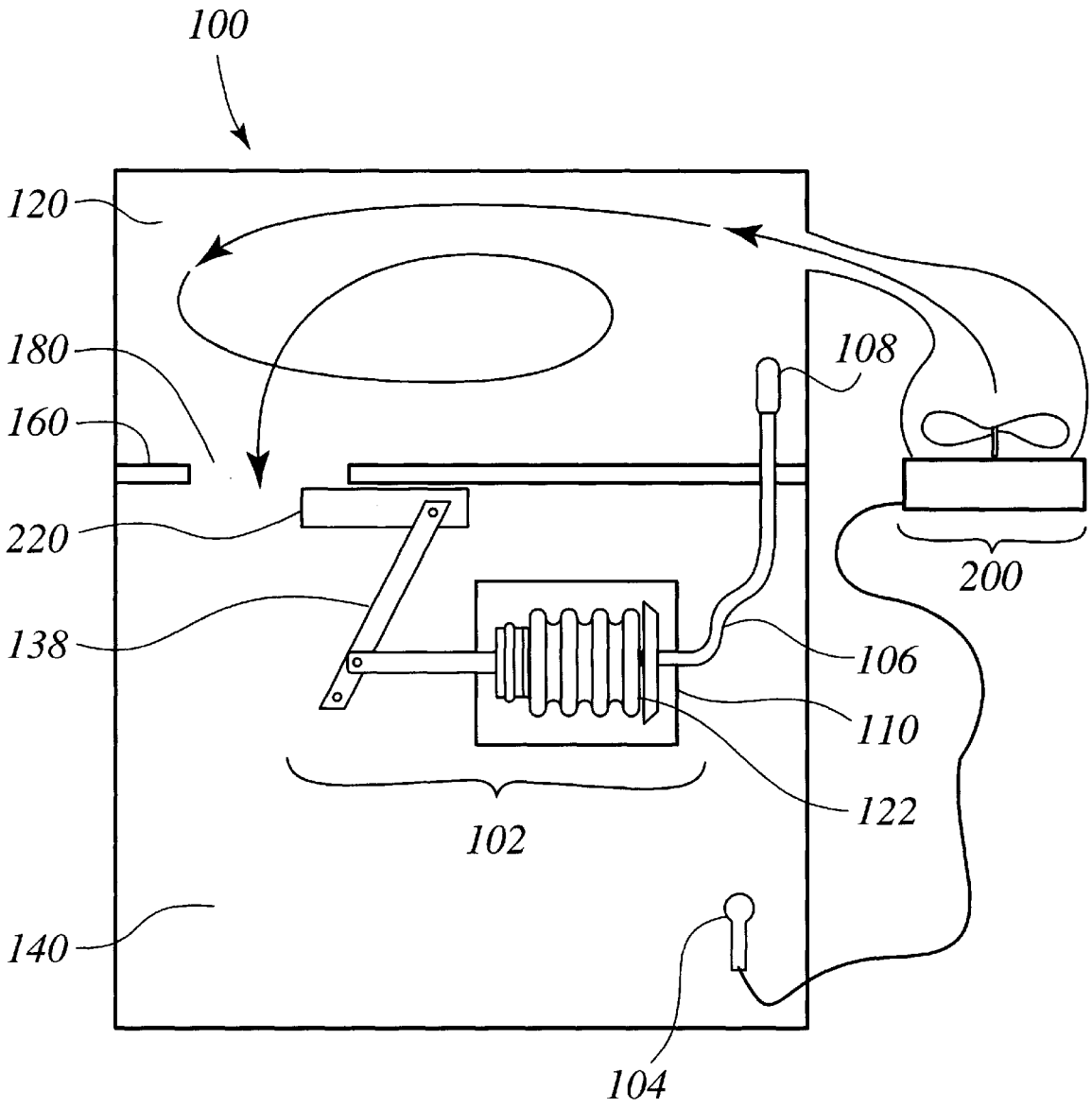
FIG. 2 is a cross-sectional schematic view similar to that of FIG. 1, of a refrigerator including a refrigeration system which incorporates an actuator of the present invention.

As shown in FIG. 2 an embodiment of a refrigerator system 100, which incorporates the adapter 102 of the present invention, comprises a relatively low temperature freezer compartment or freezer 120 and a relatively high temperature fresh food compartment 140.

The freezer 120 and fresh food compartment 140 are separated by a partition 160 having an opening or aperture 180, which extends from the freezer 120 to the fresh food compartment 140. The air circulating system includes a cold air source 200, which provides cold air directly to the freezer 120, while a portion of the cold air is directed to the fresh food compartment 140 through an aperture 180 in the partition 160. The cold air source 200 is located behind the refrigerator 100 or below the fresh food compartment 140.

Also shown in FIG. 2, is the actuator 102 which controls the damper 220 in response to the temperature of the freezer 120, as opposed to common damper controllers which actuate in response to the temperature of the fresh food compartment (see FIG. 1). Moreover, this embodiment of a refrigeration system includes a thermostat 104 located in the fresh food compartment 140, in contrast to conventional systems, which typically have the thermostat in the freezer (see FIG. 1).

In operation, as shown in FIG. 2, the cold air source 200 is controlled in response to a signal from the thermostat 104 which senses the temperature of the fresh food compartment 140. The thermostat may be located in any part of the fresh food compartment, but is typically located substantially away from the partition aperture (i.e., at an opposite end of the compartment 140 therefrom). The thermostat may be attached to the refrigerator wall or contained in the walls. The damper 220 and automatic damper controller or actuator 102 are actuated by a signal from the sensing end 108, of the temperature sensor 106, which senses the temperature in the freezer 120.

Also shown in FIG. 2 are the lever arm 138, the bellows 122 and the frame 110. In a preferred embodiment, the frame 110 is located on the partition 160 within the fresh food compartment 140. The frame 110 may be formed from a single injection molded piece or from any other suitable material, such as any metal or plastic.

Figure 3:
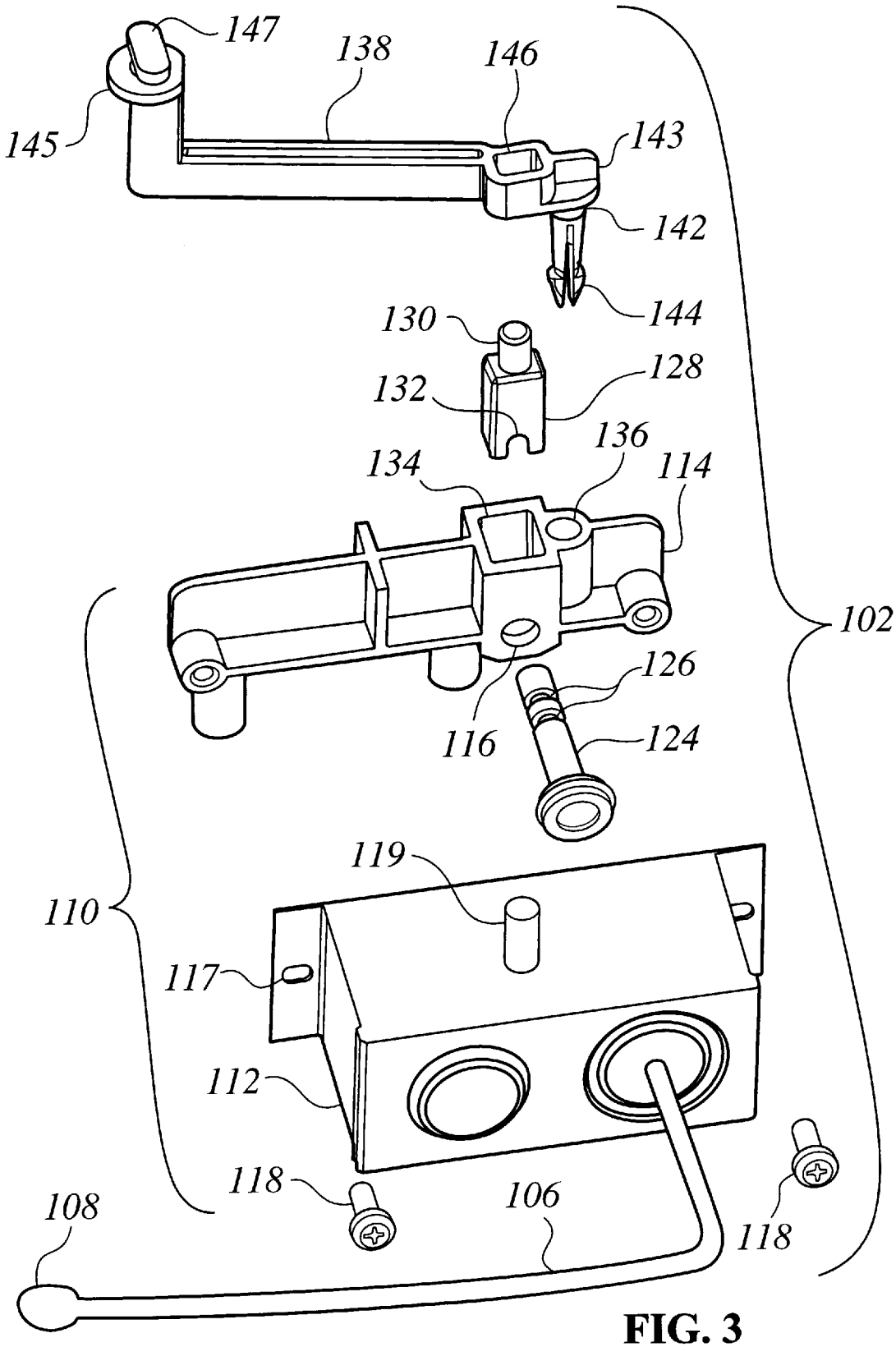
FIG. 3 is an exploded view, on an enlarged scale, of the actuator of FIG. 2.
Figure 4:
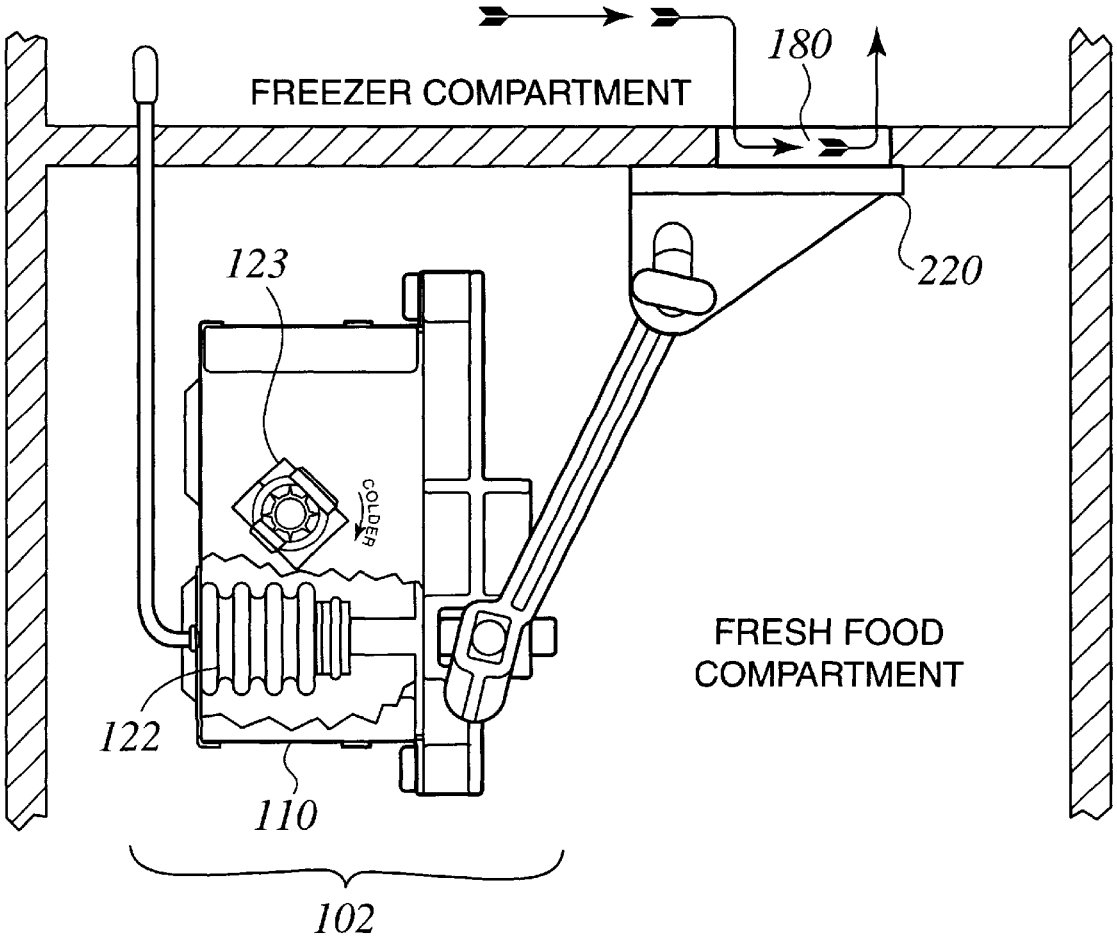
FIG. 4 is a partially broken away, front sectional view, on an enlarged scale, of a portion of a refrigerator including an embodiment of the actuator of FIGS. 2 and 3, with a damper in a closed position.

Turning now to FIG. 3, various components of the actuator 102 are shown, with the exception of the linear oscillator or bellows 122 (see FIG. 4). As shown, the temperature sensor 106, having a sensing end 108, is attached to the frame 110 of actuator 102. As shown, the temperature sensor extends from the frame up through the partition 160 and then terminates in the freezer 120 at the sensing end 108 (as shown in FIG. 2). As also shown, the sensing end 108 may be a bulb shape and be filled with fluid, such as, for example, in the event the temperature sensor is a capillary tube bulb.

One skilled in the art will recognize that a capillary tube bulb is a hollow tubular device that has a fluid filled bulb on one of its ends, and is typically used for sensing temperature changes. Another component of the actuator is the frame 110, which is shown in FIG. 3. In one embodiment, the frame comprises a housing 112 and an elongated holder 114 fabricated as two distinct parts. The housing may be rectangular shaped and have bolts 118 and boltholes 117 to allow for easy mounting to the partition or refrigerator. The elongated holder 114 includes a rigid member 134, a rigid member pin aperture 136 and a guide hole 116.

A push rod 124 extends out of the housing 112 and in through the guide hole 116 and connects to a sliding member 128. The push rod may also have one or more second clip connectors or annular grooves 126 which may be used to attach the push rod to the first clip connector 132 of the sliding member 128. In another embodiment, the push rod 124 and sliding member 128 are fabricated as one piece (not shown). A sliding member 128 which may be a rectangular shaped member having semicircular grooves or a first clip connector 132 on an end, for clipingly attaching to the second clip connector 126, is shown in FIG. 3. The sliding member 128 extends substantially perpendicularly to the push rod 124.

The sliding member may also have a sliding member knob or cylindrical portion 130, which may be cylindrical in shape. This sliding member knob 130 is disposed inside an aperture 146 in the lever arm 138. The rigid member 134 limits the movement of the sliding member 128 and indirectly limits the stroke of the damper 220. In one embodiment (not shown) the elongated holder 114 and the housing 112 may be formed as a single, integrated device. The rigid member 134 may be non-rectangular in shape. The elongated holder 114 also includes a holder pivot hole or pin aperture 136 for accepting a pindle or lever arm pin 142. The housing 112 may be attached to the elongated holder 114 with bolts 118 or other suitable fastening devices.

Figure 5:
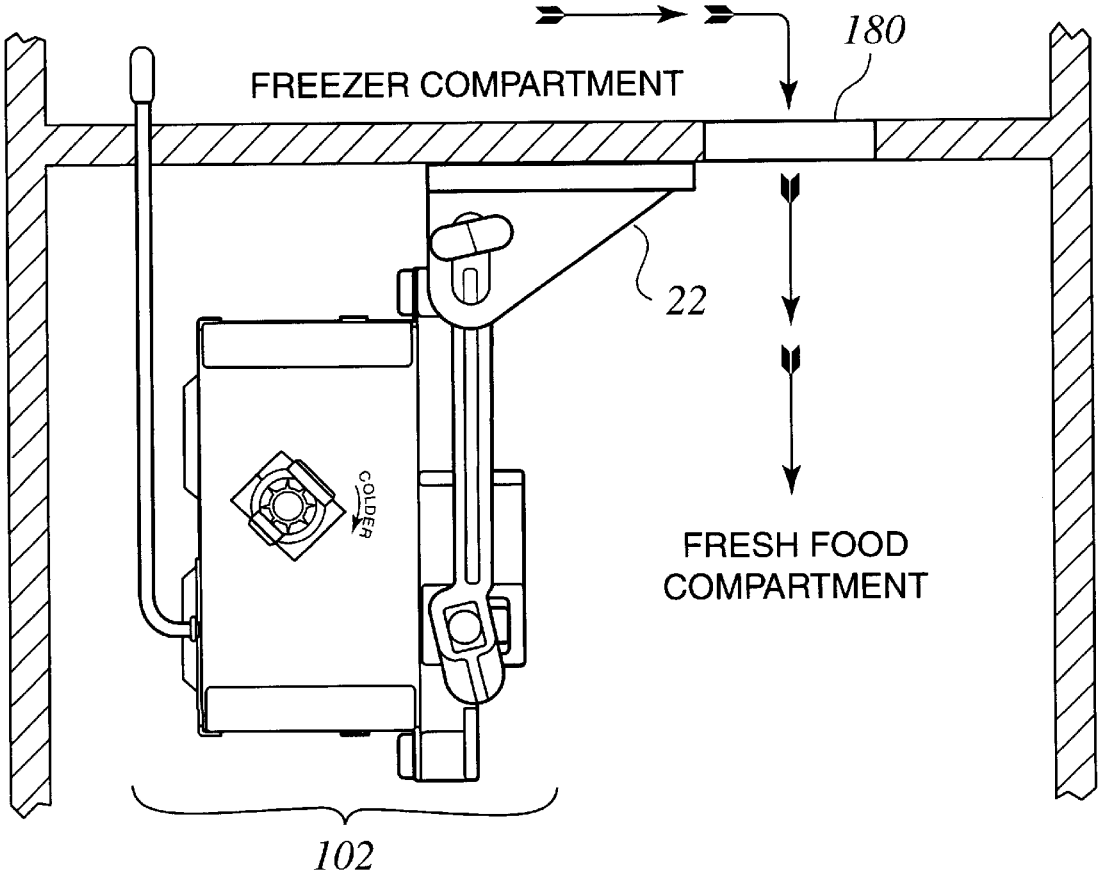
FIG. 5 is a view similar to that of FIG. 4, with the damper in an open position.

In a preferred embodiment the lever arm 138 has a first end 145 and second end 143. The first end 145 has a protruding member 147 for engaging with the damper 220 and a second end 143 has a lever arm aperture 146 and a lever arm pin 142. The lever arm aperture 146 and a lever arm pin 142 respectively engage with the cylindrical portion or sliding member knob 130 and the holder pivot hole or rigid member pin aperture 136. The lever arm pin 142 may have a spring type retaining step 144 to substantially keep the lever arm 138 attached to the elongated holder 114. The protruding member 147 is disposed in an orifice formed in the damper 220 (FIGS. 4 & 5).

The orifice in the damper 220 is larger than the protruding member 147 in a direction perpendicular to the partition 160 to allow movement in that direction, so that the lever arm 138 may be rigid and yet still move the damper 220 in a direction parallel to the partition 160. Such movement will be discussed in greater detail hereinbelow with respect to FIGS. 4 & 5. The lever arm pin 142 is rotatably contained in the rigid member pin aperture 136, which allows the first end 145 of the lever arm 138 to pivot about pin 142. The lever arm aperture 146 slidably receives the sliding member knob 130 therein. The sliding member knob 130 rotatably drives the lever arm 138 to generate the aforementioned pivotal movement as the linear oscillator (i.e., bellows) 122 expands or contracts. In another embodiment (not shown), the damper 220 and the lever arm 138 may be fabricated as one piece.

As best shown in FIG. 4, the actuator 102 may move the damper 220 to a closed position in which the aperture 180 is covered by the damper 220. Conversely, as best shown in FIG. 5, the actuator 102 may also move the damper 220 to an open position in which the aperture 180 is not covered by the damper 220. When the damper 220 is in the open position, the colder air in the freezer 120 begins to sink into the fresh food compartment 140.

As also shown in FIG. 4, the actuator 102 preferably comprises a bellows 122 and a frame 110. The frame 110 may also include one or more control knobs 123 for modifying the stroke of the bellows, and in turn, the stroke of the damper 220. The bellows 122 is located in the frame 110, which, as discussed hereinabove, may be located inside the fresh food compartment 140. The bellows 122 is filled with refrigerant or other similar fluid capable of appreciably expanding and contracting in response to variations in temperature. When the temperature changes, the bellows fluid expands or contracts to cause the bellows 122 to axially expand or contract. This contraction or expansion moves the push rod 124, which is connected to one end of the bellows.

As shown and described herein, the linear oscillator preferably includes a fluid filled bellows. However, the skilled artisan should recognize that any device capable of generating a linear, oscillating or reciprocating movement, such as an electrically or electronically controlled linear actuator, may be used without departing from the spirit and scope of the present invention.

An important aspect of the refrigeration system 100 is that the cold air source 200 is actuated in response to the temperature of the air in the fresh food compartment 140 and not the temperature of the air in the freezer 120. The thermostat 104, which controls the cold air source 200, is located in the fresh food compartment 140 and the actuator 102 controls the damper 220 in response to the air temperature in the freezer 120. This refrigeration system 100 relatively accurately and quickly controls the temperature in the fresh food compartment.

Table 1 compares the cooling process steps of this refrigeration system 100 to a previous system. The cooling process steps are the different steps that each system takes in response to a temperature variation in the fresh food compartment. For convenience, "ffc" will be used to designate "fresh food compartment". The set point temperatures refer to the preset high and low temperature range settings of the compartments. For example, when the air temperature in the fresh food compartment reaches a set point temperature, the cold air source will be either turned on or off.

TABLE 1

Comparison of Cooling Process Steps

| Steps | Previous System | Refrigerator System (100) |
|---|---|---|
| 1 | The cold air source has just turned off because the freezer has reached its set point temperature. The damper is partially or fully closed. | The cold air source has just turned off because the ffc has reached its set point temperature. The damper is fully open. |
| 2 | The ffc temperature increases because the ffc door is opened. | The ffc temperature increases because ffc door is opened |

TABLE 1-continued

Comparison of Cooling Process Steps

| Steps | Previous System | Refrigerator System (100) |
|---|---|---|
| 3 | Gradually the automatic damper begins to open in response to the temperature increase | The **cold air source is turned on** because the thermostat in the ffc senses a temperature change. |
| 4 | The warmer air begins to mix with the colder freezer air and eventually the damper fully opens. | The warmer air starts rising into the freezer and the cold air starts moving into the freezer |
| 5 | The **cold air source is turned on** when the freezer air warms up because it blends with the warmer ffc air. (without the help of a fan) temperature. | The cold air falls through the aperture into the ffc and will not stop moving into the ffc until the ffc temperature is cooled to its set point |
| 6 | Cold air enters the freezer and also starts cooling the ffc through the aperture by mixing with the ffc air. | The damper fully opens and the cold air source is off because the ffc has reached its set point temperature. |
| 7 | The cold air source is turned off when the freezer reaches its set point temperature, even though the ffc air still may be warm. The damper is partially or fully closed. | The damper closes as the freezer warms. This prevents colder air from leaving freezer. As the ffc warms the cold air source turns on. |

One advantage of the refrigeration system 100 is that the fresh food compartment temperatures are relatively accurately maintained within the high and low set point temperature ranges. As described in Table 1, the cold air source will not turn off until the temperature of the fresh food compartment has reached its low set point temperature. Conversely, the cold air source of the previous system is turned off when the freezer reaches its low set point temperature, even though the temperature of the fresh food compartment may be much warmer than the desired set point temperature. Such control of the fresh food compartment temperature and resulting warm air in the fresh food compartment of the previous system may cause food in the fresh food compartment to spoil.

Another advantage of the refrigeration system 100 is that the fresh food compartment is cooled very quickly after a temperature variation, such as, for example, when the fresh food compartment door is opened up and warm outside air fills the fresh food compartment. As described in Table 1, as soon as there is a temperature variation in the fresh food compartment of the refrigeration system 100, the cold air source is turned on (i.e., refrigeration system step 3 of Table 1) and the cold air will quickly enter the fresh food compartment.

Contrariwise, the previous system must first complete many process steps before the cold air source is turned on, (i.e., prior art steps 3–5 of Table 1) in response to a temperature variation in the fresh food compartment.

The actuator of the present invention may be advantageously used to easily retrofit a prior art refrigerator having a manually controlled damper. This is an inexpensive means of providing the benefits of an automatically controlled damper actuator without having to purchase or redesign a new refrigerator. In addition, the lever arm amplifies the amount of damper travel. The clip connection between the push rod and the lever arm eliminates the need for a spring. Lastly, the rigid member also limits the stroke of the lever arm to ensure accurate opening and closing of the damper.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described the invention, what is claimed is:

1. A reverse action actuator for controlling temperatures in a multiple compartment device having:

at least a first compartment and a second compartment separated by a partition having an aperture extending therethrough, the first and second compartments being maintainable at discrete temperatures by conditioned fluid being supplied to the first compartment in response to a thermostat disposed in the second compartment;

a damper located in the second compartment, the damper being translatable to alternately substantially open and substantially close the aperture, wherein the conditioned air flows through the aperture affecting the temperature in the second compartment;

said actuator being drivingly coupled to the damper, wherein said actuator is actuatable in response to a temperature sensor having a sensing end located in the first compartment, said actuator comprising:

a linear oscillator being coupled with the temperature sensor;

a push rod disposed integrally with said linear oscillator, wherein said linear oscillator reciprocably moves said push rod along its longitudinal axis;

a holder including a rigid member and a pin aperture;

a sliding member having a knob on one end and a first clip connector at an other end, said sliding member having a range of motion limited by said rigid member;

said push rod including a second clip connector at one end, said second clip connector being coupled to said first clip connector;

a lever arm having a first end and a second end, said first end including a protruding member;

said second end including a lever arm aperture and a lever arm pin;

said knob being pivotably engaged with said lever arm aperture;

said lever arm pin being pivotably engaged with said pin aperture; and said protruding member adapted for being pivotably coupled with the damper, wherein said actuator opens the damper in response to a relatively cold temperature and closes the damper in response to a relatively warm temperature.

2. The actuator of claim 1, wherein said linear oscillator comprises a bellows being coupled to a capillary tube sensor.

3. The actuator of claim 1, wherein said second clip connector comprises grooves on one end of said push rod.

4. The actuator of claim 1, wherein said rigid member comprises a wall of a bore disposed in said holder.

5. The actuator of claim 4, wherein said holder is disposed integrally with said housing.

6. The actuator of claim 1, wherein said first clip connector is semi-circular.

7. The actuator of claim 3 wherein:

said push rod is substantially cylindrical and said second clip connector includes at least one annular recess extending substantially circumferentially about said push rod.

8. The actuator of claim 2, wherein said bellows further comprises a fluid disposed therein, which fluid alternately expands and contracts in response to changes in temperature to effect said actuation.

9. An actuator for facilitating the controlling of temperatures in a refrigerator, said actuator comprising:

a housing;

a bellows disposed within said housing, said bellows having a fluid disposed therein, which fluid alternately expands and contracts in response to changes in temperature to effect said actuation, and said bellows being coupled with the temperature sensor;

a push rod being substantially cylindrical and disposed integrally with said bellows, wherein said bellows reciprocably moves said push rod along its longitudinal axis;

a holder disposed integrally with said housing, said holder including a rigid member and a pin aperture, said rigid member comprising a wall of a bore disposed in said holder;

a sliding member having a knob on one end and a semi-circular first clip connector at an other end, said sliding member having a range of motion limited by said rigid member;

said push rod having a second clip connector on one end, said second clip connector including annular recesses extending substantially circumferentially about said push rod;

said second clip connector being coupled to said first clip connector;

a lever arm having a first end and a second end;

said first end including a protruding member;

said second end including a lever arm aperture and a lever arm pin;

said knob being pivotably engaged with said lever arm aperture;

said lever arm pin being pivotably engaged with said pin aperture; and said protruding member adapted for being pivotably coupled with the damper, wherein said actuator facilitates conversion of a manual damper into an automatically actuated damper system.

10. A method of fabricating an actuator for selectively opening and closing a damper to control temperatures in a refrigerator, said method comprising the steps of:

(a) providing a linear oscillator which is operable in response to input from a temperature sensor;

(b) integrally disposing a push rod with the linear oscillator, wherein the linear oscillator reciprocably moves the push rod along its longitudinal axis;

(c) providing a holder including a rigid member and a pin aperture;

(d) providing a sliding member having a knob at one end and a first clip connector at an other end, the sliding member having a range of motion limited by the rigid member;

(e) providing a second clip connector on one end of the push rod;

(f) coupling the second clip connector to the first clip connector;

(g) providing a lever arm having a first end and a second end the first end including a protruding member, and the second end including a lever arm aperture and a lever arm pin;

(h) pivotably engaging the knob with the lever arm aperture; and (i) pivotably engaging the lever arm pin with the pin aperture, wherein the protruding member is pivotably couplable with the damper.

* * * * *